US008926826B2

(12) United States Patent
Dindi et al.

(10) Patent No.: US 8,926,826 B2
(45) Date of Patent: Jan. 6, 2015

(54) LIQUID-FULL HYDROPROCESSING TO IMPROVE SULFUR REMOVAL USING ONE OR MORE LIQUID RECYCLE STREAMS

(75) Inventors: Hasan Dindi, Wilmington, DE (US); Luis Eduardo Murillo, Wilmington, DE (US)

(73) Assignee: E I du Pont de Nemours and Company, Wilmington, DE (US)

( * ) Notice: Subject to any disclaimer, the term of this patent is extended or adjusted under 35 U.S.C. 154(b) by 444 days.

(21) Appl. No.: 13/096,309

(22) Filed: Apr. 28, 2011

(65) Prior Publication Data

US 2012/0273390 A1 Nov. 1, 2012

(51) Int. Cl.

| | |
|---|---|
| ***C10G 65/04*** | (2006.01) |
| ***C10G 45/22*** | (2006.01) |
| ***C10G 65/12*** | (2006.01) |

(52) U.S. Cl.

CPC ..... *C10G 65/04* (2013.01); *C10G 45/22* (2013.01); *C10G 65/12* (2013.01); *C10G 2300/202* (2013.01); *C10G 2300/4081* (2013.01); *C10G 2300/4018* (2013.01); *C10G 2300/1051* (2013.01); *C10G 2300/1055* (2013.01); *C10G 2300/1059* (2013.01); *C10G 2300/802* (2013.01)

USPC ..... 208/49; 208/59; 208/108; 208/210; 208/251 H; 208/254 H

(58) Field of Classification Search

USPC ..... 208/59, 49, 108, 210, 251 H, 254 H

See application file for complete search history.

(56) References Cited

U.S. PATENT DOCUMENTS

| | | | | |
|---|---|---|---|---|
| 2,185,516 | A | | 1/1940 | Nisson |
| 2,987,467 | A | | 6/1961 | Keith et al. |
| 3,150,196 | A | | 9/1964 | Mason |
| 3,281,352 | A | | 10/1966 | Schuman |
| 3,363,992 | A | | 1/1968 | Chervenak |
| 3,461,061 | A | | 8/1969 | Stine et al. |
| 3,461,063 | A | | 8/1969 | Stine et al. |
| 3,498,907 | A | | 3/1970 | Doelp et al. |
| 3,519,557 | A | | 7/1970 | Pruiss |
| 3,714,022 | A | | 1/1973 | Stine |
| 3,718,575 | A | * | 2/1973 | Watkins ..... 208/59 |
| 3,788,973 | A | | 1/1974 | Wolk et al. |

(Continued)

FOREIGN PATENT DOCUMENTS

| | | |
|---|---|---|
| AU | 2003200780 | 5/2003 |
| CN | 101280218 A | 10/2008 |

(Continued)

OTHER PUBLICATIONS

PCT International Search Report and Written Opinion dated Aug. 21, 2012.

(Continued)

*Primary Examiner* — Prem C Singh
*Assistant Examiner* — Brandi M Doyle
(74) *Attorney, Agent, or Firm* — Hanxing Zheng

(57) ABSTRACT

The present invention provides a process for hydroprocessing hydrocarbons in liquid full reactors with one or more independent liquid recycle streams. The process operates as a liquid-full process, wherein all of the hydrogen dissolves in the liquid phase and one or more of the recycle streams may actually be zero. Hydrocarbons can be converted in the process to provide liquid products such as clean fuels with multiple desired properties.

21 Claims, 2 Drawing Sheets

(56) References Cited

U.S. PATENT DOCUMENTS

| | | | | |
|---|---|---|---|---|
| 4,110,202 | A | 8/1978 | Winter, III | |
| 4,364,819 | A | 12/1982 | Hutchings et al. | |
| 4,818,369 | A | 4/1989 | Bortz | |
| 5,026,951 | A | 6/1991 | Schmidt et al. | |
| 5,059,741 | A | 10/1991 | Foley | |
| 5,245,102 | A | 9/1993 | Zarchy et al. | |
| 5,254,748 | A | 10/1993 | Hensley et al. | |
| 5,326,925 | A | 7/1994 | Sachtler | |
| 5,360,535 | A | 11/1994 | Liu et al. | |
| 5,510,564 | A | 4/1996 | Raghuram et al. | |
| 5,567,860 | A | 10/1996 | Mowry et al. | |
| 5,568,737 | A | 10/1996 | Campbell et al. | |
| 6,037,515 | A | 3/2000 | Wimmer | |
| 6,123,835 | A | 9/2000 | Ackerson et al. | |
| 6,428,686 | B1 | 8/2002 | Ackerson et al. | |
| 6,638,418 | B1 | 10/2003 | Kalnes et al. | |
| 6,881,326 | B2 | 4/2005 | Ackerson et al. | |
| 7,291,257 | B2 | 11/2007 | Ackerson et al. | |
| 7,569,136 | B2 | 8/2009 | Ackerson et al. | |
| 2005/0006283 | A1* | 1/2005 | Leung et al. | 208/213 |
| 2006/0144756 | A1* | 7/2006 | Ackerson et al. | 208/108 |
| 2009/0095651 | A1* | 4/2009 | Leonard et al. | 208/49 |
| 2009/0321310 | A1 | 12/2009 | Kokayeff et al. | |
| 2010/0000908 | A1 | 1/2010 | Markkanen et al. | |
| 2010/0155294 | A1 | 6/2010 | Kokayeff et al. | |
| 2011/0147264 | A1* | 6/2011 | Sadler et al. | 208/59 |

FOREIGN PATENT DOCUMENTS

| | | | |
|---|---|---|---|
| CN | 101280219 | A | 10/2008 |
| CN | 101338219 | A | 1/2009 |
| CN | 101338220 | A | 1/2009 |
| CN | 101708448 | A | 5/2010 |
| CN | 101787305 | A | 7/2010 |
| DE | 3029808 | A | 2/1981 |
| FR | 1237708 | | 6/1960 |
| GB | 1 072 225 | A | 6/1967 |
| WO | 9859019 | A1 | 12/1998 |
| WO | 2006/102534 | A2 | 9/2006 |
| WO | 2006102534 | A3 | 9/2006 |
| WO | 2010009077 | A2 | 1/2010 |

OTHER PUBLICATIONS

Bianchini et al., Multiphase Homogeneous Catalysis, 2005, vol. 1, 196-202, Wiley-VCH Verlag GmbH & Co., Weinheim, Germany.

Dassori, Three Phase Reactor Modeling with Significant Backmixing in the Liquid Phase Using a Modified Cell Model (MCM), 1998, S679-S682, vol. 22, Supplement, Elsevier Science Ltd.

Datsevitch et al., Improvement of the deep Desulfurization of Diesel Fuel by Pre-Saturation and a Recycle of the Liquid Phase, DGMK Tagungsbericht, 2003, 321-325.

Noda et al., Catalytic Activity of Nickel Fine Powder for Liquid-Phase Dehydrogenation of Secondary Alcohols, Nippon Kagaku Kaishi1984, vol. 6, 1071-21, Tokyo, Japan.

Schmitz et al., Deep Desulfurization of Diesel Oil: Kinetic Studies and Process Improvent by the Use of a Two Phase Reactor with Pre-saturator, Chemical Engineering Science, 2004, vol. 59, 2821-2829, Elsevier Ltd., Germany.

* cited by examiner

LIQUID-FULL HYDROPROCESSING TO IMPROVE SULFUR REMOVAL USING ONE OR MORE LIQUID RECYCLE STREAMS

FIELD OF THE INVENTION

The present invention relates to a process for hydroprocessing hydrocarbon feeds in liquid-full reactors with one or more independent liquid recycle streams.

BACKGROUND OF THE INVENTION

Global demand for clean fuels, such as ultra-low-sulfur-diesel (ULSD), has risen quickly because many environmental regulations have been established to substantially lower the sulfur levels of fuels in order to reduce sulfur dioxide ($SO_2$) emissions from use of such fuels.

Hydroprocessing processes have been used to treat hydrocarbon feeds to produce clean fuels. Such processes include hydrodesulfurization (HDS) and hydrodenitrogenation (HDN), which remove sulfur and nitrogen, respectively, from the feeds.

Conventional hydroprocessing processes use trickle bed reactors, in which hydrogen is transferred from a vapor phase through a liquid phase hydrocarbon feed to react with the feed at the surface of a solid catalyst. Thus, three phases (gas, liquid and solid) are present. Trickle bed reactors are expensive to operate and require large quantities of hydrogen, much of which must be recycled through expensive hydrogen compressors. Heat removal from the highly exothermic hydroprocessing processes is inefficient. Significant coke forms on the surfaces of catalysts in trickle bed reactors, causing catalyst deactivation.

Ackerson, in U.S. Pat. No. 6,123,835, discloses a two-phase hydroprocessing system which eliminates the need to circulate hydrogen through the catalyst. In the two-phase hydroprocessing system, a solvent or a recycled portion of hydroprocessed liquid effluent acts as diluent and is mixed with a hydrocarbon feed. Hydrogen is dissolved in the feed/diluent mixture to provide hydrogen in the liquid phase. All of the hydrogen required in the hydroprocessing reaction is available in solution.

Two-phase hydroprocessing systems contain a single liquid recycle stream to increase dissolved hydrogen availability throughout a reactor. The recycle stream eliminates hydrogen gas recirculation through the catalyst and provides a heat sink for a uniform temperature distribution. However recycle has disadvantages. Recycle introduces back-mixing to the system, which reduces conversion, e.g., sulfur removal efficiency. Back-mixing reduces catalyst efficiency because reaction products, such as $H_2S$ and $NH_3$, which are present in the recycle stream take up the catalyst active sites. This causes difficulty in competing with conventional trickle bed reactors, which do not have liquid recycle, in kinetically limited regions, i.e., reducing sulfur below 10 ppm for ULSD. By "kinetically limited region", it is meant herein where organic sulfur concentration is very low (such as around 10-50 ppm). The reaction rate of organic sulfur conversion is reduced, kinetically limited, at such low sulfur concentrations in the presence of recycle, which includes reaction products. Use of a recycle stream introduces reacted sulfur (as $H_2S$) back into the reactor (back-mixing) which reduces rate of sulfur conversion. Thus, sulfur removal efficiency is reduced.

Therefore, it is desirable to have a process for hydroprocessing hydrocarbon feeds in a smaller and simpler system with increased sulfur and nitrogen conversions.

SUMMARY OF THE INVENTION

The present invention provides a process for hydroprocessing a hydrocarbon feed, which comprises (a) providing two or more reaction stages disposed in sequence and in liquid communication, wherein each reaction stage contains at least one catalyst bed, and each catalyst bed contains at least one catalyst; (b) contacting the feed with (i) a diluent and (ii) hydrogen, to produce a feed/diluent/hydrogen mixture, wherein the hydrogen is dissolved in the feed/diluent/hydrogen mixture; (c) contacting the feed/diluent/hydrogen mixture with a first catalyst in a first reaction stage, to produce a first product effluent; (d) recycling a portion of the first product effluent as a first recycle stream for use in the diluent in step (b)(i) at a first recycle ratio of from about 0.1 to about 10, preferably a first recycle ratio of from about 0.1 to about 6; and (e) contacting at least a portion of a product effluent, wherein the product effluent in this step (e) is the product effluent from the reaction stage preceding a final reaction stage, with a final catalyst in the final reaction stage, to produce a final product effluent; wherein each contacting step (c) and (e) is performed under liquid-full reaction conditions.

Optionally, the process further comprises after step (d) and before step (e), step (d') which comprises contacting at least a portion of a product effluent, wherein the product effluent in this step (d') is the product effluent from the reaction stage preceding a final reaction stage, with hydrogen to produce a product effluent/hydrogen mixture, wherein the hydrogen is dissolved in the product effluent/hydrogen mixture. When the process includes this optional step (d'), the product effluent/hydrogen mixture of step (d') replaces the at least a portion of a product effluent in step (e), which is contacted with the final catalyst in step (e).

Optionally, one or more reaction stages is present between the first reaction stage and the final reaction stage, each such stage referred to herein as a "current reaction stage". For each current reaction stage, the process of this invention further comprises (i) providing a preceding product effluent, which is the product effluent from the preceding reaction stage, to the current reaction stage; (ii) optionally contacting the preceding product effluent with hydrogen; (iii) optionally contacting the preceding product effluent with a current recycle stream; (iv) contacting the preceding product effluent with a current catalyst to produce a current product effluent; (v) optionally recycling a portion of the current product effluent as the current recycle stream; and (vi) feeding the current product effluent to a subsequent reaction stage. Thus, a current reaction stage may consist of (i') providing a preceding product effluent, which is the product effluent from the preceding reaction stage, to the current reaction stage; (ii') contacting the preceding product effluent with a current catalyst to produce a current product effluent; and (iii") feeding the current product effluent to a subsequent reaction stage. For each current reaction stage having a recycle stream, in which optional steps (iii) and (v) are performed, the recycle ratio of current recycle stream to product effluent from the preceding reaction stage is from about 0.1 to about 10, provided however that the recycle ratio in a reaction stage cannot be larger than the recycle ratio in the preceding reaction stage.

For purposes herein, a "preceding stage" means the stage immediately preceding a current stage, that is, with no intervening stages.

Optionally, a final recycle stream is present in a final reaction stage. This optional process comprises steps (a), (b), (c), and (d) as described above. This embodiment further comprises after step (d) and before step (e), a step (d") which comprises contacting at least a portion of a product effluent, wherein the product effluent in this step (d") is the product effluent from the reaction stage preceding a final reaction stage, with a final recycle stream to produce a product effluent/final recycle stream mixture. When the process includes this optional step (d"), the product effluent/final recycle stream mixture of step (d") replaces the at least a portion of a product effluent in step (e), which is contacted with the final catalyst in step (e). This process further comprises (f) recycling a portion of the final product effluent as a final recycle stream for use in step (d") at a final recycle ratio of from about 0.05 to about 5, preferably a final recycle ratio of from about 0.05 to about 1; and provided the final recycle ratio is smaller than the first recycle ratio.

Yet another alternative process further comprises contacting hydrogen and a final recycle stream with the at least a portion of a product effluent. This process comprises steps (a), (b), (c), and (d) as described above and further comprises after step (d) and before step (e), a step (d'") which comprises contacting at least a portion of a product effluent, wherein the product effluent in this step (d'") is the product effluent from the reaction stage preceding a final reaction stage, with a final recycle stream and hydrogen to produce a product effluent/final recycle stream/hydrogen mixture. When the process includes this optional step (d'"), the product effluent/final recycle stream/hydrogen mixture of step (d'") replaces the at least a portion of a product effluent in step (e), which is contacted with the final catalyst in step (e). This process further comprises (f') recycling a portion of the final product effluent as a final recycle stream for use in step (d'") at a final recycle ratio of from about 0.05 to about 5, preferably a final recycle ratio of from about 0.05 to about 1; and provided the final recycle ratio is smaller than the first recycle ratio.

The process of the present invention is able to provide a liquid product with lower sulfur and nitrogen contents, that meet ULSD requirements.

The process of this invention operates as a liquid-full process and each contacting step (c) and (f) and optional step (iii) is performed under liquid-full reaction conditions. By "liquid-full process", it is meant herein that all of the hydrogen added in the process for the hydroprocessing step can be dissolved in the process liquids. By "liquid-full reaction", it is meant no gas phase hydrogen is present during the reaction of contacting the hydrogen and feed with a catalyst.

DETAILED DESCRIPTION

Figure 1:
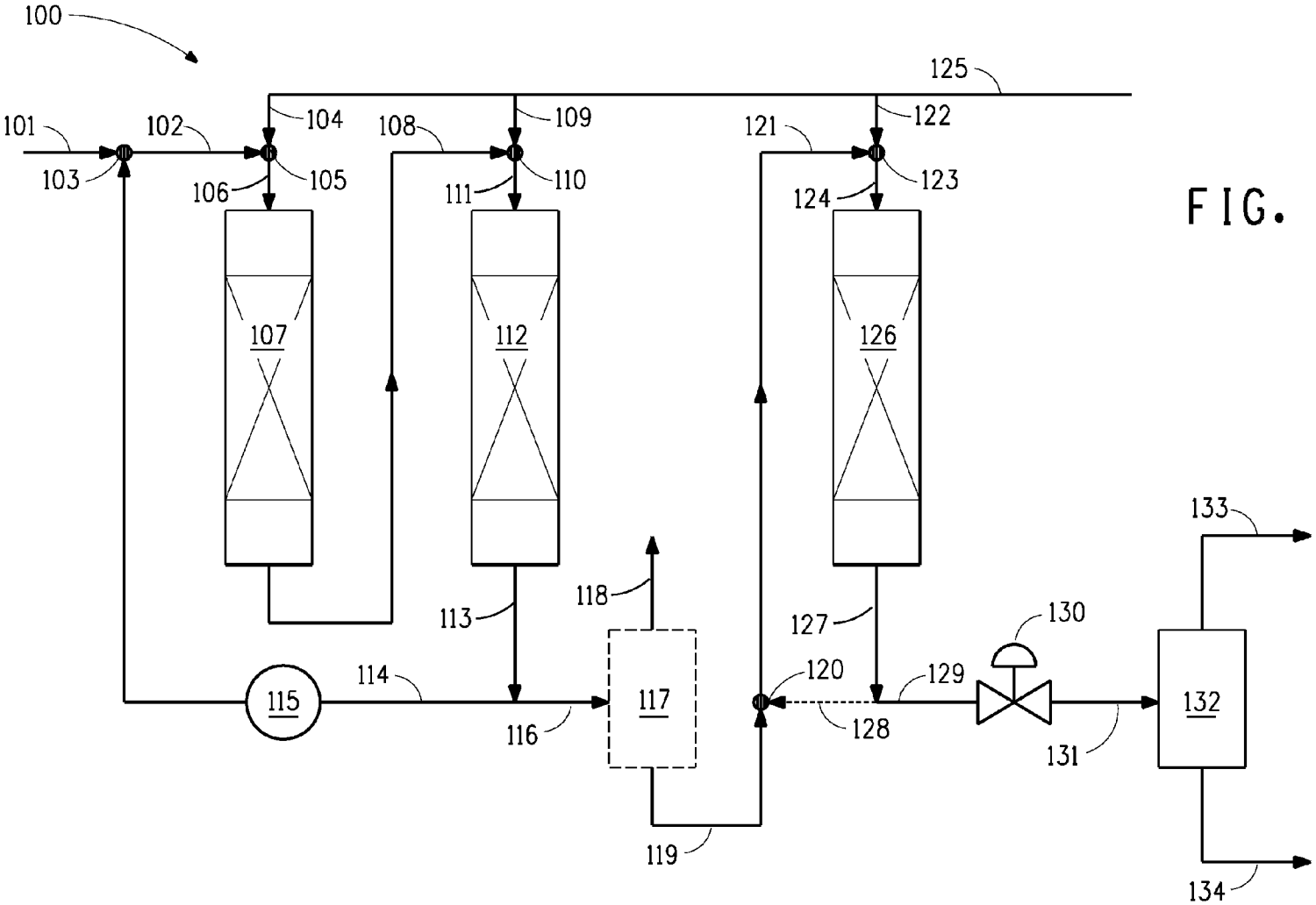
FIG. 1 is a flow diagram illustrating a hydrocarbon conversion process of this invention with a final catalyst bed outside a recycle stream.

In the process of the present invention, multiple reaction stages, each with one or more independent liquid recycle streams, are used in a liquid-full hydroprocessing process. Recycle is controlled among the stages such that sulfur and nitrogen conversions are increased, and the overall process becomes more effective to provide a low sulfur and low nitrogen.

Advantageously, liquid back-mixing is reduced by having smaller recycle ratios relative to the first recycle ratio in the second and the subsequent recycles, optionally eliminating the second or the subsequent recycle streams. Reduced back-mixing improves conversion. Higher conversion of sulfur and nitrogen provides an opportunity to produce products which meet Euro V specifications (<10 ppm) for ultra low sulfur diesel (ULSD), and nitrogen content is reduced to below 10 ppm.

The process of this invention comprises (a) providing two or more reaction stages disposed in sequence and in liquid communication, wherein each reaction stage contains at least one catalyst bed, and each catalyst bed contains at least one catalyst; (b) contacting a hydrocarbon feed with (i) a diluent and (ii) hydrogen, to produce a feed/diluent/hydrogen mixture, wherein the hydrogen is dissolved in the feed/diluent/hydrogen mixture; (c) contacting the feed/diluent/hydrogen mixture with a first catalyst in a first reaction stage, to produce a first product effluent; (d) recycling a portion of the first product effluent as a first recycle stream for use in the diluent in step (b)(i) at a first recycle ratio of from about 0.1 to about 10; and (e) contacting at least a portion of a product effluent, wherein the product effluent in this step (e) is the product effluent from the reaction stage preceding a final reaction stage, with a final catalyst in the final reaction stage, to produce a final product effluent. Each contacting step (c) and (e) is performed under liquid-full reaction conditions.

In the step (a) of the process of this invention, multiple reaction stages are provided. By "reaction stage", it is meant herein a set of one or more catalyst beds.

One or more reaction stages may be present between the first reaction stage and the final reaction stage. Each reaction stage between the first reaction stage and the final reaction stage is referred to herein as the "current reaction stage". Associated catalyst, product effluent, etc., are referred to as "current catalyst", "current product effluent" and the like.

For each current stage the process of this invention further comprises (i) providing a preceding product effluent, which is the product effluent from the preceding reaction stage, to the current reaction stage; (ii) optionally contacting the preceding product effluent with hydrogen; (iii) optionally contacting the preceding product effluent with a current recycle stream; (iv) contacting the preceding product effluent with a current catalyst to produce a current product effluent; (v) optionally recycling a portion of the current product effluent as the current recycle stream; and (vi) feeding the current product effluent to a subsequent reaction stage. When a current stage has a recycle stream, that is, optional steps (iii) and (v) are performed, the recycle ratio of current recycle stream to product effluent from the preceding reaction stage is from about 0.1 to about 10, provided however that the recycle ratio in any reaction stage cannot be larger than the recycle ratio in the preceding reaction stage.

When a current reaction stage lacks a recycle stream, the process of this invention further comprises (i') providing a preceding product effluent, which is the product effluent from the preceding reaction stage, to the current reaction stage; (ii') contacting the preceding product effluent with a current catalyst to produce a current product effluent; and (iii") feeding the current product effluent to a subsequent reaction stage.

In one embodiment of the present invention, each reaction stage contains one independent liquid recycle stream with a corresponding recycle ratio. Each recycle ratio and the number of stages having recycle stream, depends on factors such as the selection of hydrocarbon feed(s) to be processed. A first recycle ratio is larger than a final recycle ratio, and the recycle ratio of a reaction stage is the same, or at least is not smaller than the recycle ratio of a subsequent reaction stage. Preferably, the recycle ratio of a reaction stage is larger than the recycle ratio of a subsequent reaction stage.

A first reaction stage may contain at least one catalyst bed within one recycle stream, and a final reaction stage may contain at least one catalyst bed with no recycle stream.

When a reaction stage has a recycle stream and contains only one catalyst bed, a portion of the product effluent from the outlet of the catalyst bed is recirculated to the inlet of the same catalyst bed.

When a reaction stage has a recycle stream and contains two or more catalyst beds, a portion of the product effluent from the outlet of the last catalyst bed of the reaction stage is recycled to the inlet of the first catalyst bed of the same reaction stage. Thus, all catalyst beds of the reaction stage are included within a single recycle stream.

When a reaction stage contains two or more catalyst beds, a portion of the product effluent from the outlet of the last catalyst bed of a preceding reaction stage is directed to the inlet of the first catalyst bed of a subsequent reaction stage.

In one embodiment, the process of the present invention has two reaction stages. The first reaction stage has a first recycle stream having a first recycle ratio of about 0.1 to about 10. The first recycle stream takes advantage of the dissolved hydrogen in the liquid, reducing mass-transfer limitations. The second reaction stage may have a second recycle stream having a second recycle ratio of about 0.05 to about 1, provided that the second recycle ratio is smaller than the first recycle ratio. Preferably there is no second recycle stream, that is, the second recycle ratio is 0. By having the second recycle ratio equal to 0, the process is competitive with trickle bed reactors in removing the last portion of the more difficult (hard) sulfur in the kinetically limited region.

Catalyst beds of the present invention may be in a single column reactor with multiple catalyst beds so long as the beds are distinct and separated. Preferably hydrogen can be fed to a location between the beds to increase hydrogen content in the product effluent between the beds. Fresh hydrogen may be added into the liquid feed/diluent/hydrogen mixture or effluent from a preceding catalyst bed at the inlet of each catalyst bed, where the added hydrogen dissolves in the mixture or effluent prior to contacting the catalyst bed.

Each reactor is a fixed bed reactor and may be of a plug flow, tubular or other design packed with a solid catalyst (i.e. a packed bed reactor). A reactor can be a single column reactor with one or more catalyst beds. Each reactor operates as a liquid-full reactor, in which all of the hydrogen is dissolved in the liquid phase and the reactor is free of a gas phase. The liquid feed/diluent/hydrogen mixture passes through the catalyst.

In the step (b) of the process of the present invention, a feed is contacted with a diluent and hydrogen. The feed can be contacted first with hydrogen and then with the diluent, or preferably, first with the diluent and then with hydrogen to produce a feed/diluent/hydrogen mixture.

The combination of feed and diluent is capable of dissolving all of the hydrogen in the liquid phase, without need for hydrogen in the gas phase. That is, the hydroprocessing process of this invention is liquid-full process.

For example, each catalyst bed may have a zone above the catalyst into which a feed/diluent/hydrogen mixture is introduced prior to contacting the mixture with the catalyst. Additional hydrogen gas may be added to this zone, and mixed and/or flashed with the mixture so that the hydrogen is dissolved in the mixture. To achieve liquid-full reaction zones with introduction of hydrogen, the hydrogen gas is contacted with feed, diluent and/or feed diluent combinations. If necessary a separator may be present to remove excess hydrogen gas from feed/diluent/hydrogen mixtures to maintain the process as a liquid-full process.

The diluent comprises, consists essentially of, or consists of a recycle stream. The recycle stream is a portion of the product effluent that is recycled and combined with the hydrocarbon feed before or after contacting the feed with hydrogen, preferably before contacting the feed with hydrogen.

In addition to the recycle stream, the diluent may comprise any other organic liquid that is compatible with the hydrocarbon feed and catalysts. When the diluent comprises an organic liquid in addition to the recycle stream, preferably the organic liquid is a liquid in which hydrogen has a relatively high solubility. The diluent may comprise an organic liquid selected from the group consisting of light hydrocarbons, light distillates, naphtha, diesel and combinations of two or more thereof. More particularly, the organic liquid is selected from the group consisting of propane, butane, pentane, hexane or combinations thereof. The diluent is typically present in an amount of no greater than 90%, based on the total weight of the feed and diluent, preferably 20-85%, and more preferably 50-80%.

In the hydroprocessing process of this invention, organic nitrogen and organic sulfur are converted to ammonia and hydrogen sulfide, respectively, in one or more of the contacting steps (c) and (e). There is no separation of ammonia, hydrogen sulfide and remaining hydrogen from the product effluent from the first catalyst bed or the product effluent from the preceding bed prior to feeding the effluent to the subsequent bed. The resulting ammonia and hydrogen sulfide after the hydroprocessing steps are dissolved in the liquid product effluent. A recycle stream is combined with fresh feed without separating ammonia and hydrogen sulfide and remaining hydrogen from the final product effluent. Still, the catalysts throughout the hydroprocessing process of the present invention do not exhibit deactivation or coking on the catalyst surface.

A portion of the first product stream is recycled in step (d) as the first recycle stream. The process has a higher recycle ratio for the first recycle stream than recycle ratio(s) in subsequent recycles.

Optionally, hydrogen is added to the feed, that is the at least a portion of the product effluent from the reaction stage preceding a final reaction stage. This optional process comprises steps (a), (b), (c), and (d) as described above. The process further comprises after step (d) and before step (e), step (d') which comprises contacting at least a portion of a product effluent, wherein the product effluent in this step (d') is the product effluent from the reaction stage preceding a final reaction stage, with hydrogen to produce a product effluent/hydrogen mixture, wherein the hydrogen is dissolved in the product effluent/hydrogen mixture. When the process includes this optional step (d'), the product effluent/hydrogen mixture of step (d') replaces the at least a portion of a product effluent in step (e), which is contacted with the final catalyst in step (e).

Optionally, a portion of effluent of the final stage is recycled to the final stage as a final recycle stream. This optional process comprises steps (a), (b), (c), and (d) as described above. This embodiment further comprises after step (d) and before step (e), a step (d") which comprises contacting at least a portion of a product effluent, wherein the product effluent in this step (d") is the product effluent from the reaction stage preceding a final reaction stage, with a final recycle stream to produce a product effluent/final recycle stream mixture. When the process includes this optional step (d"), the product effluent/final recycle stream mixture of step (d") replaces the at least a portion of a product effluent in step (e), which is contacted with the final catalyst in step (e). This process further comprises (f) recycling a portion of the final product effluent as a final recycle stream for use in step (d") at a final recycle ratio of from about 0.05 to about 5, preferably a final recycle ratio of from about 0.05 to about 1; and provided the final recycle ratio is smaller than the first recycle ratio.

Yet another alternative process comprises steps (a), (b), (c), and (d) as described and further comprises contacting both hydrogen and a final recycle stream with the at least a portion of a product effluent. This process comprises after step (d) and before step (e), a step (d'") which comprises contacting at least a portion of a product effluent, wherein the product effluent in this step (d'") is the product effluent from the reaction stage preceding a final reaction stage, with a final recycle stream and hydrogen to produce a product effluent/final recycle stream/hydrogen mixture. When the process includes this optional step (d'"), the product effluent/final recycle stream/hydrogen mixture of step (d'") replaces the at least a portion of a product effluent in step (e), which is contacted with the final catalyst in step (e). This process further comprises (f') recycling a portion of the final product effluent as a final recycle stream for use in step (d'") at a final recycle ratio of from about 0.05 to about 5, preferably a final recycle ratio of from about 0.05 to about 1; and provided the final recycle ratio is smaller than the first recycle ratio.

Preferably, there is no recycle stream for the final reaction stage, i.e., the recycle ratio=0. Alternatively, a final recycle stream may be added to the final reaction stage at a final recycle ratio of from about 0.05 to about 5, preferably at a final recycle ratio of from about 0.05 to about 1.

Optionally, at least a portion of the liquid product effluent from a reaction stage can be directed to a high pressure separator or a flash unit where waste gases such as $H_2S$ and $NH_3$ are removed to produce a stripped stream before the stripped stream is directed to a subsequent reaction stage. Stripping improves catalyst efficiency of the subsequent reaction stage(s), as sulfur and nitrogen conversions are increased.

In the present invention, hydrogen is recycled as a dissolved component of a recycle stream.

At least a portion of the final product effluent from step (f) is directed to a control valve where the final product effluent is flashed to atmospheric pressure to produce a flashed stream. If a final recycle stream is used only a portion of the final product effluent is directed to the control valve. If there is no final recycle stream, all of the product effluent is directed to the control valve. The flashed stream is directed to a separator, where lighter products (such as light naphtha, hydrogen sulfide, ammonia, $C_1$ to $C_4$ gaseous hydrocarbons and the like) are separated from the main liquid product, which is collected and called Total Liquid Product (TLP).

The hydrocarbon feed can be any hydrocarbon composition containing undesirable amounts of contaminants (sulfur, nitrogen, metals) and/or aromatics and/or having a viscosity of at least 0.5 cP, a density of at least 750 kg/m$^3$ at a temperature of 15.6° C. (60° F.), and an end boiling point in the range of from about 350° C. (660° F.) to about 700° C. (1300° F.). The hydrocarbon feed can be mineral oil, synthetic oil, petroleum fractions, or combinations of two or more thereof. A petroleum fraction is jet fuel, kerosene, straight run diesel, light cycle oil, light coker gas oil, gas oil, heavy cycle oil, heavy coker gas oil, heavy gas oil, any other petroleum distillate, resid, diesel fuel, deasphalted oil, waxes, lubes, specialty products, or combinations of two or more thereof. Preferably, the hydrocarbon feed is selected from the group consisting of jet fuel, kerosene, straight run diesel, light cycle oil, light coker gas oil, gas oil, heavy cycle oil, heavy coker gas oil, heavy gas oil, resid, deasphalted oil, and combinations of two or more thereof. The process of this invention can be used to convert such feeds to a product that meets ULSD specifications.

The process of the present invention can operate under a wide variety of conditions, from light, to mild and to extreme. Temperature for the process of this invention ranges from about 204° C. to about 450° C., preferably from about 300° C. to about 450° C., and more preferably from about 300° C. to 400° C. Pressure for the hydroprocessing process of this invention ranges from about 3.45 MPa (34.5 bar) to 17.3 MPa (173 bar).

The hydrocarbon feed is fed to the first catalyst bed at a rate to provide a liquid hourly space velocity (LHSV) of from about 0.1 to about 10 hr$^{-1}$, preferably, about 0.4 to about 8 hr$^{-1}$, more preferably about 0.4 to about 5.0 hr$^{-1}$.

The hydroprocessing process of this invention uses two or more catalyst beds, wherein each catalyst bed contains a catalyst. Each catalyst is a hydrotreating catalyst or hydrocracking catalyst. By "hydrotreating", it is meant herein a process in which a hydrocarbon feed reacts with hydrogen for the removal of heteroatoms, such as sulfur, nitrogen, oxygen, metals and combinations thereof, or for hydrogenation of olefins and/or aromatics, in the presence of a hydrotreating catalyst. By "hydrocracking", it is meant herein a process in which a hydrocarbon feed reacts with hydrogen for breaking carbon-carbon bonds to form hydrocarbons of lower average boiling point and lower average molecular weight in the presence of a hydrocracking catalyst.

In one embodiment, at least one catalyst is a hydrotreating catalyst. In another embodiment, at least one catalyst is a hydrocracking catalyst. Each catalyst may be a hydrotreating catalyst. One or more catalyst beds which contain a hydrotreating catalyst may be followed by one or more catalyst beds which contain a hydrocracking catalyst.

A hydrotreating catalyst comprises a metal and an oxide support. The metal is a non-precious metal selected from the group consisting of nickel, cobalt and combinations thereof, preferably combined with molybdenum and/or tungsten. The hydrotreating catalyst support is a mono- or mixed-metal oxide, preferably selected from the group consisting of alumina, silica, titania, zirconia, kieselguhr, silica-alumina and combinations of two or more thereof.

A hydrocracking catalyst also comprises a metal and an oxide support. The metal is also a non-precious metal selected from the group consisting of nickel, cobalt and combinations thereof, preferably combined with molybdenum and/or tungsten. The hydrocracking catalyst support is a zeolite, amorphous silica, or a combination thereof.

Preferably the metal for the catalysts used in the present invention is a combination of metals selected from the group consisting of nickel-molybdenum (NiMo), cobalt-molybdenum (CoMo), nickel-tungsten (NiW) and cobalt-tungsten (CoW).

Catalysts for use in the present invention may further comprise other materials including carbon, such as activated charcoal, graphite, and fibril nanotube carbon, as well as calcium carbonate, calcium silicate and barium sulfate.

Catalysts for use in the present invention include known commercially available hydroprocessing catalysts. It is within the scope of the present invention that more than one type of hydroprocessing catalyst be used in a single column reactor with multiple beds.

Preferably, the catalyst is in the form of particles, more preferably shaped particles. By "shaped particle" it is meant the catalyst is in the form of an extrudate. Extrudates include cylinders, pellets, or spheres. Cylinder shapes may have hollow interiors with one or more reinforcing ribs. Trilobe, cloverleaf, rectangular- and triangular-shaped tubes, cross, and "C"-shaped catalysts can be used. Preferably a shaped catalyst particle is about 0.25 to about 13 mm (about 0.01 to about 0.5 inch) in diameter when a packed bed reactor is used. More preferably, a catalyst particle is about 0.79 to about 6.4 mm (about 1/32 to about 1/4 inch) in diameter. Such catalysts are commercially available.

The catalysts may be sulfided before and/or during use by contacting the catalyst with a sulfur-containing compound at an elevated temperature. Suitable sulfur-containing compound include thiols, sulfides, disulfides, $H_2S$, or combinations of two or more thereof. The catalyst may be sulfided before use ("pre-sulfiding") or during the process ("sulfiding") by introducing a small amount of a sulfur-containing compound in the feed or diluent. The catalysts may be pre-sulfided in situ or ex situ and the feed or diluent may be supplemented periodically with added sulfur-containing compound to maintain the catalysts in sulfided condition.

DETAILED DESCRIPTION OF THE FIGURES

FIG. 1 illustrates an integrated hydroprocessing unit 100 for one embodiment of the process of this invention. Certain detailed features of the proposed process, such as pumps, compressors, separation equipment, feed tanks, heat exchangers, product recovery vessels and other ancillary process equipment are not shown for the sake of simplicity and in order to demonstrate the main features of the process. Such ancillary features will be appreciated by one skilled in the art. It is further appreciated that such ancillary and secondary equipment can be easily designed and used by one skilled in the art without any difficulty or undue experimentation or invention.

Fresh hydrocarbon feed 101 is combined with a portion of first recycle stream 114 from bed 112, through pump 115 at mixing point 103, to provide combined liquid feed 102. Hydrogen gas is mixed with combined liquid feed 102 via line 104 at mixing point 105 to introduce sufficient hydrogen to saturate combined liquid feed 102. The resulting combined liquid feed/first recycle stream/hydrogen mixture 106 flows into first catalyst bed 107 (bed 1). Bed 1 and bed 2 are in a first reaction stage.

Main hydrogen head 125 is the source for hydrogen make-up to the three catalyst beds 107 (bed 1), 112 (bed 2) and 126 (bed 3).

Effluent 108 from the first catalyst bed 107, is mixed with additional fresh hydrogen gas 109 at mixing point 110 and the combined liquid-stream 111 flows to second catalyst bed 112 (bed 2). Effluent 113 from second catalyst bed 112 is split wherein a portion of effluent 113 is returned to first catalyst bed 107 as first recycle stream 114 through pump 115 to mixing point 103. The ratio of first recycle stream 114 to fresh hydrocarbon feed 101 is preferably between 0.1 and 10 (the recycle ratio).

The other portion 116 of effluent 113 is either directly sent as feed 121 to bed 126 (bed 3) or sent to separation unit 117, which can be, for example, a high pressure separator or a flash unit. Gases 118 are removed from separation unit 117. From separation unit 117, liquid effluent 119 may or may not be mixed with effluent 128 of third catalyst bed 126 at mixing point 120.

If bed 126 has no recycle stream 128, liquid effluent 119 from separator 117 is mixed with more hydrogen 122 at mixing point 123. The combined hydrocarbon liquid-dissolved hydrogen stream 124 is fed to third catalyst bed 126. At least a portion 129 of effluent 127 of bed 126 is sent to control valve 130. Effluent 127 may be split into second recycle stream 128, an independent recycle stream, third catalyst bed 126. Effluent 131 from control valve 130 is fed to separator 132. Gases 133 are removed from top of separator 132. Total liquid product 134 is removed from bottom of separator 132.

The liquid flow (feed, diluent, including recycle stream, and hydrogen) in FIG. 1 is illustrated as downflow through the beds 1-3. Preferably the feed/diluent/hydrogen mixture and product effluents are fed to the reactors in an downflow mode. An upflow process is also contemplated herein. FIG. 1 illustrates an embodiment in which has an option of no recycle stream for the final bed.

Figure 2:
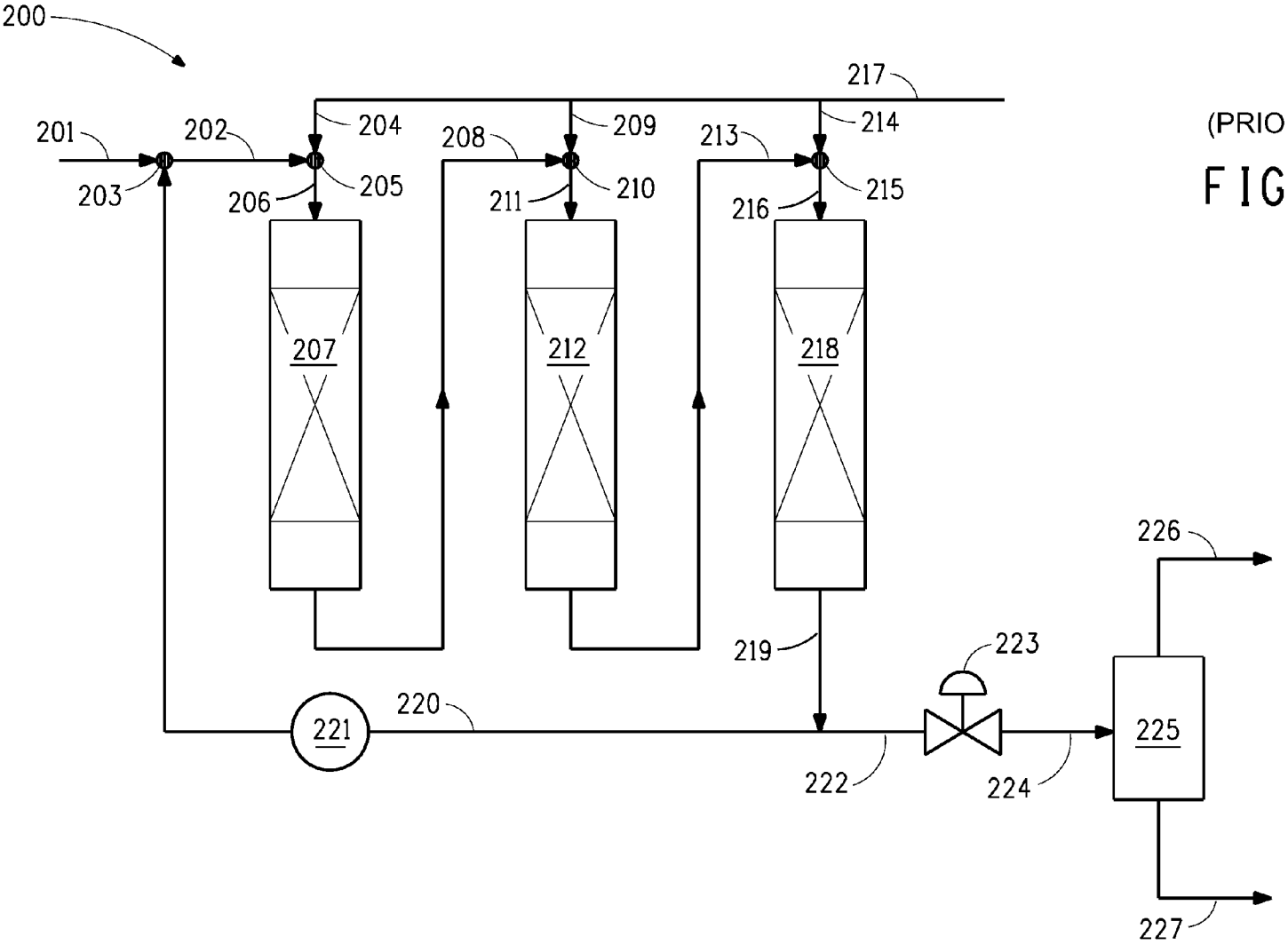
(PRIOR ART) FIG. 2
FIG. 2 is a flow diagram illustrating a comparative hydrocarbon conversion process with all catalyst beds in a single recycle stream.

FIG. 2 illustrates an integrated hydroprocessing unit 200 for a comparative hydrocarbon conversion process. As with FIG. 1, some common components for a hydrocarbon conversion process are not illustrated for simplicity.

Fresh hydrocarbon feed 201 is introduced to the process and combined with recycle stream 220 of effluent 219 from third catalyst bed 218 (bed 3) at mixing point 203. Hydrogen gas 204 is mixed with the combined liquid feed 202 at mixing point 205 to add sufficient hydrogen to saturate the combined liquid feed. The resulting combined liquid feed/recycle stream/hydrogen mixture 206 flows into first catalyst bed 207 (bed 1).

Main hydrogen head 217 is the source for hydrogen make-up to the beds.

Effluent 208 from bed 207 is mixed with additional fresh hydrogen gas 209 at mixing point 210. Combined liquid-stream 211 flows to second catalyst bed 212 (bed 2). Effluent 213 from second catalyst bed 212 is mixed with more hydrogen 214 at mixing point 215. Combined liquid stream 216 flows to third catalyst bed 218 (bed 3). Effluent 219 from bed 218 is split. A portion of effluent 219 is recycle stream 220, which is returned to the inlet of bed 207 through pump 221 to mixing point 203 to provide combined liquid feed 202. The ratio of recycle stream 220 to fresh hydrocarbon feed 201 is preferably between 0.1 and 10 (the recycle ratio).

The other portion 222 of effluent 219 is sent to control valve 223 where it is flashed to atmospheric pressure. Flashed stream 224 from control valve 223 is fed to separator 225. Light products 226, which may include light naphtha, hydrogen sulfide, ammonia, $C_1$ to $C_4$ gaseous hydrocarbons and the like, are removed from the top of separator 225. Total Liquid Product 227 is removed from the bottom of separator 225.

Effluent 131 from control valve 130 is fed to separator 132. Gases 133 are removed from top of separator 132. Total liquid product 134 is removed from bottom of separator 132

EXAMPLES

Analytical Methods and Terms

ASTM Standards. All ASTM Standards are available from ASTM International, West Conshohocken, Pa., www.astm.org.

Amounts of sulfur, nitrogen and basic nitrogen are provided in parts per million by weight, wppm.

Total Sulfur was measured using ASTM D4294 (2008), "Standard Test Method for Sulfur in Petroleum and Petroleum Products by Energy Dispersive X-ray Fluorescence Spectrometry," DOI: 10.1520/D4294-08 and ASTM D7220 (2006), "Standard Test Method for Sulfur in Automotive Fuels by Polarization X-ray Fluorescence Spectrometry," DOI: 10.1520/D7220-06

Total Nitrogen was measured using ASTM D4629 (2007), "Standard Test Method for Trace Nitrogen in Liquid Petroleum Hydrocarbons by Syringe/Inlet Oxidative Combustion and Chemiluminescence Detection," DOI: 10.1520/D4629-07 and ASTM D5762 (2005), "Standard Test Method for Nitrogen in Petroleum and Petroleum Products by Boat-Inlet Chemiluminescence," DOI: 10.1520/D5762-05.

Aromatic content was determined using ASTM Standard D5186-03 (2009), "Standard Test Method for Determination of Aromatic Content and Polynuclear Aromatic Content of Diesel Fuels and Aviation Turbine Fuels by Supercritical Fluid Chromatography", DOI: 10.1520/D5186-03R09.

Boiling range distribution was determined using ASTM D2887 (2008), "Standard Test Method for Boiling Range Distribution of Petroleum Fractions by Gas Chromatography," DOI: 10.1520/D2887-08.

Density, Specific Gravity and API Gravity were measured using ASTM Standard D4052 (2009), "Standard Test Method for Density, Relative Density, and API Gravity of Liquids by Digital Density Meter," DOI: 10.1520/D4052-09.

"API gravity" refers to American Petroleum Institute gravity, which is a measure of how heavy or light a petroleum liquid is compared to water. If API gravity of a petroleum liquid is greater than 10, it is lighter than water and floats; if less than 10, it is heavier than water and sinks. API gravity is thus an inverse measure of the relative density of a petroleum liquid and the density of water, and is used to compare relative densities of petroleum liquids.

The formula to obtain API gravity of petroleum liquids from specific gravity (SG) is:

$$API\ \text{gravity}=(141.51/SG)-131.5$$

Bromine Number is a measure of aliphatic unsaturation in petroleum samples. Bromine Number was determined using ASTM Standard D1159, 2007, "Standard Test Method for Bromine Numbers of Petroleum Distillates and Commercial Aliphatic Olefins by Electrometric Titration," DOI: 10.1520/D1159-07.

"LHSV" means liquid hourly space velocity, which is the volumetric rate of the liquid feed divided by the volume of the catalyst, and is given in $hr^{-1}$.

Refractive Index (RI) was determined using ASTM Standard D1218 (2007), "Standard Test Method for Refractive Index and Refractive Dispersion of Hydrocarbon Liquids," DOI: 10.1520/D1218-02R07.

"WABT" means weighted average bed temperature.

The following examples are presented to illustrate specific embodiments of the present invention and not to be considered in any way as limiting the scope of the invention.

Example 1

A straight run diesel (SRD) from a commercial refinery having the properties shown in Table 1 was hydroprocessed in an experimental pilot unit containing a set of three liquid-full, fixed bed reactors in series similar to the flow diagram as illustrated in FIG. 1. However, the pilot unit introduced feed, recycle streams and hydrogen in an upflow mode to the reactors.

Reactors #1 and #2 were inside a first liquid recycle stream, whereas reactor #3 was outside this liquid recycle stream. Reactor #3 did not have a liquid recycle stream. In other words, the liquid recycle ratio for Reactor #3 was zero.

TABLE 1

Properties of the Straight Run Diesel

| Property | Unit | Value |
|---|---|---|
| Total Sulfur | wppm | 6765 |
| Total Nitrogen | wppm | 86 |
| Refractive Index at 20° C. | | 1.4737 |
| Density at 20° C. (68° F.) | g/ml | 0.8494 |
| Density at 15.56° C. (60° F.) | g/ml | 0.8526 |
| API Gravity | | 34.3 |
| Bromine No. | g/100 g | <0.5 |
| Aromatics | | |
| Monoaromatics | wt. % | 24.4 |
| Polyaromatics | wt. % | 7.9 |
| Total Aromatics | wt. % | 32.3 |
| Boiling Point Distribution | % | ° C. |
| IBP = Initial boiling point | IBP | 124 |
| | 5 | 207 |
| | 10 | 230 |
| | 20 | 258 |
| | 30 | 271 |
| | 40 | 283 |
| | 50 | 292 |
| | 60 | 301 |
| | 70 | 310 |
| | 80 | 322 |
| | 90 | 338 |
| | 95 | 350 |
| | 99 | 374 |
| FBP = Final boiling point | FBP | 386 |

Each fixed bed reactor was constructed of 316 L stainless steel tubing in 19 mm (¾") OD and about 49 cm (19¼") in length with reducers to 6 mm (¼") on each end. Both ends of the reactors were first capped with metal screen to prevent catalyst leakage. Inside the metal screens, the reactors were packed with a layer of 1 mm glass beads at both ends followed by a hydroprocessing catalyst packed in the middle.

Reactors #1, #2, and #3 were each packed with 60 ml of a commercial hydrotreating catalyst, KF-767 (Co—Mo on $\gamma$-$Al_2O_3$ from Albemarle Corp., Baton Rouge, La.). KF-767 consisted of quadralobes of 1.3 mm diameter and 10 mm long.

Each reactor was placed in a temperature-controlled sand bath, a 120 cm long steel pipe filled with fine sand having 7.6 cm OD (3" Nominal) and. Temperatures were monitored at the inlet and outlet of each reactor. Temperature was controlled using heat tapes which were connected to temperature controllers and wrapped around the 8.9 cm O.D. sand bath. The sand bath pipe was wrapped with two independent heat tapes to maintain a uniform temperature throughout the reactor.

The hydrotreating catalyst (a total of 180 ml) was charged to the reactors and was dried overnight at 115° C. under a total flow of 300 standard cubic centimeters per minute (sccm) of hydrogen gas. The reactors were heated to 176° C. with flow of charcoal lighter fluid (CLF) through the catalyst beds. Sulfur spiked-CLF (1 wt % sulfur, added as 1-dodecanethiol) and hydrogen gas mixture was passed through the reactors at 176° C. to pre-sulfide the catalysts.

The pressure was 6.9 MPa (1000 psig or 69 bar). The temperature of the reactors was increased gradually to 320° C. Pre-sulfiding was continued at 320° C. until breakthrough of hydrogen sulfide ($H_2S$) was observed at the outlet of Reactor #3.

After pre-sulfiding, the catalyst was stabilized by flowing a straight run diesel (SRD) through the catalysts in the reactors at a temperature varying from 320° C. to 355° C. and at pressure of 6.9 MPa (1000 psig or 69 bar) for approximately 10 hours.

After pre-sulfiding and stabilizing the catalyst with SRD at pressure of (6.9 MPa), the temperatures in the reactor beds (WABT) were adjusted to 304° C. The positive displacement feed pump was adjusted to a flow rate of 6 ml/minute for a hydrotreating LHSV of 2.0 $hr^{-1}$. The total hydrogen feed rate was 47.5 l/l (267 scf/bbl) based on the fresh SRD feed. The pressure was 4.6 MPa (675 psig, 46.5 bar). The recycle ratio was 4 for the first stage. The reactors were maintained under the above conditions for at least 12 hours to assure that the catalyst was fully precoked and the system was lined-out with the SRD feed while testing for both total sulfur and density.

Hydrogen gas, fed from compressed gas cylinders, was metered using dedicated mass flow controllers. The hydrogen was mixed with the liquid SRD feed stream and a portion of the effluent from Reactor #2, the first liquid recycle stream, in a 6 mm OD 316L stainless steel tubing ahead of each reactor. The liquid SRD/hydrogen/recycle stream was preheated in the 6-mm OD tubing in the temperature controlled sand bath in a down-flow mode and was then introduced to Reactor #1 in an up-flow mode.

After exiting Reactor #1, additional hydrogen was dissolved in the liquid product of Reactor #1 (feed to Reactor #2). The feed to Reactor #2 was again preheated in 6 mm OD tubing in a second temperature controlled sand bath in a down-flow mode and was then introduced to Reactor #2 in an up-flow mode.

After exiting Reactor #2, the effluent was split into a recycle stream and an intermediate product stream. The recycle stream was pumped using an Eldex piston metering pump to combine with additional fresh SRD feed upstream of Reactor #1. The recycle stream served as diluent to dissolve additional $H_2$ for the process.

The intermediate product stream from Reactor #2 was mixed with additional hydrogen which was dissolved in the liquid stream prior to entering Reactor #3, which was a single pass catalyst bed outside any recycle stream. The product from Reactor #3 was then flashed, cooled, and separated into gas and liquid product streams.

A Total Liquid Product (TLP) sample and an off-gas sample were collected under steady state conditions. The sulfur and nitrogen contents were measured and overall material balances were calculated by using a GC-FID to account for light ends in the off-gas. Results are shown in Table 2.

From the total hydrogen feed and hydrogen in the off-gas, the hydrogen consumption was calculated to be 20.41 l/l (115 scf/bbl).

The sulfur and nitrogen contents of the TLP sample collected during the test were found to be 1921 ppm and 38 ppm, respectively. The density at 15.6° C. (60° F.) of TLP sample collected during this experiment was also found to be 848.4 $kg/m^3$ yielding an API gravity of 35.1.

Examples 2-4

The process of Example 1 was repeated with the following changes. Each of Examples 2-4 were run at an LHSV of 1.3 $hr^{-1}$. Examples 2-4 were run at temperatures of 338° C. (640° F.), 321° C. and 304° C., respectively. These conditions and results are shown in Table 2.

TABLE 2

Summary for Examples 1 to 4

| Example | LHSV, $hr^{-1}$ | WABT, ° C. | RR | Density$^{15.6°\ C.}$ g/cc | S wppm |
|---|---|---|---|---|---|
| Feed | | | | 0.8526 | 6765 |
| 1 | 2.0 | 304 | 4 | 0.8484 | 1921 |
| 2 | 1.3 | 338 | 4 | 0.8443 | 265 |
| 3 | 1.3 | 321 | 4 | 0.8461 | 766 |
| 4 | 1.3 | 304 | 4 | 0.8478 | 1615 |

RR is recycle ratio.

The results show that increasing the severity of the reaction (lower LHSV and higher WABT) decreases the sulfur content in the TLP. Product sulfur goes from 1921 in the Example 1 (304° C. and 2.0 $hr^{-1}$) is 1921 wppm, while sulfur is reduced to 265 ppm at the highest temperature and lower space velocity (338° C. and 1.3 $hr^{-1}$).

Comparative Examples A through D

The straight run diesel used Examples 1-4 was hydroprocessed in Comparative Examples A through D, in a reactor configuration as illustrated in FIG. 2, with the similar exception as in Examples 1-4 that the feed, recycle streams and hydrogen were introduced in an upflow mode to the reactors. These Comparative Examples represent the current state-of-the-art of the liquid-full hydroprocessing technology.

In these Comparative Examples, only a single liquid recycle was used and all three reactors in series were placed inside this single liquid recycle stream. All three reactors were packed with 60 ml, each, of the same catalyst (KF-767) used in Examples 1 to 4. The temperatures and space velocities of Examples 1-4 were repeated in Comparative Examples A-D, respectively.

In Comparative Examples A-D, total liquid product from Reactor #3 was split as recycle and product. Hydrogen gas was fed from compressed gas cylinders using mass flow controllers and was injected in liquid streams before each reactor.

The SRD/hydrogen/recycle stream mixture was preheated in a 6 mm OD stainless steel tubing in a temperature-controlled sand bath before entering Reactor #1 in an up-flow mode.

Additional hydrogen was injected in the liquid product exiting Reactor #1 (the feed to Reactor #2). The effluent of Reactor #1 was then preheated in another sand bath before entering Reactor #2 in an up-flow mode. The above procedure was also repeated for Reactor #3.

The liquid effluent of Reactor #3 was split into a recycle stream and a final product stream. The final product from Reactor #3 was then flashed, cooled down, and separated into a gas and a liquid product stream.

The recycle stream was pumped around all three reactors by a piston metering pump, and the discharge of the pump was mixed with fresh SRD feed. The recycle stream served as diluent and media to dissolve additional $H_2$.

The hydrotreating catalyst was loaded, dried, pre-sulfided and stabilized as described in Example 1. The reactor temperatures (WABT) were adjusted to 304° C. with a fresh SRD flow rate of 6 ml/min (LHSV of 2.0 $hr^{-1}$), the total $H_2$ feed rate of 47.5 l/l (267 scf/bbl), and a recycle ratio of 4. The pressure was kept constant at 4.6 MPa (675 psig, 46.5 bar). The reactors were maintained under these conditions for 12 hours to pre-coke the catalyst and to line out the system.

TLP and an off-gas samples were collected. Results are shown Table 3.

TABLE 3

Summary for Comparative Examples A to D

| Comp. Example | LHSV, $hr^{-1}$ | WABT, ° C. | RR | Density$^{15.6°\ C.}$ g/cc | S wppm |
|---|---|---|---|---|---|
| Feed | | | | 0.8526 | 6765 |
| A | 2.0 | 304 | 4 | 0.8487 | 2194 |
| B | 1.3 | 338 | 4 | 0.8444 | 398 |
| C | 1.3 | 321 | 4 | 0.8462 | 780 |
| D | 1.3 | 304 | 4 | 0.8479 | 1725 |

RR is recycle ratio

Comparison of results in Tables 2 and 3 shows that the sulfur levels in Comparative Examples A to D are higher (less conversion) than those in Examples 1 to 4. When the last reactor is taken outside of the liquid recycle stream, there is no back-mixing in the last bed. Conversion of sulfur is surprisingly significantly increased, which makes the liquid-full hydroprocessing more competitive.

While nitrogen removal efficiency would have been increased in Examples 1-4 compared to Comparative Examples A-D, the nitrogen content of the SRD feed used was so low that in all the cases the nitrogen was essentially zero in the product.

Comparison of the results of Examples 1-4 with those of Comparative Examples A-D illustrates utility of liquid full hydroprocessing reactors for sulfur removal.

What is claimed is:

1. A process for hydroprocessing a hydrocarbon feed, comprising: (a) providing two or more reaction stages disposed in sequence and in liquid communication, wherein each reaction stage contains at least one catalyst bed, and each catalyst bed contains at least one catalyst; (b) contacting the feed with (i) a diluent and (ii) hydrogen, to produce a feed/diluent/hydrogen mixture, wherein the hydrogen is dissolved in the feed/diluent/hydrogen mixture; (c) contacting the feed/diluent/hydrogen mixture with a first catalyst in a first reaction stage, to produce a first product effluent; (d) recycling a portion of the first product effluent as a first recycle stream for use in the diluent in step (b)(i) at a first recycle ratio of from about 0.1 to about 10; (d') optionally having one or more current reaction stages between the first reaction stage and a final reaction stage, wherein step (d') comprises (i) providing a preceding product effluent, which is the product effluent from a preceding reaction stage, to the current reaction stage; (ii) optionally contacting the preceding product effluent with hydrogen; (iii) optionally contacting the preceding product effluent with a current recycle stream; (iv) contacting the preceding product effluent with a current catalyst to produce a current product effluent; (v) optionally recycling a portion of the current product effluent as the current recycle stream at a current recycle ratio of from about 0.1 to about 10; and (vi) feeding the current product effluent to a subsequent reaction stage; (e) contacting at least a portion of a product effluent from the reaction stage preceding the final reaction stage, and optionally hydrogen, with a final catalyst in the final reaction stage, to produce a final product effluent;

wherein each contacting step (c), optional step (d')(iv), and (e) is performed under liquid-full reaction conditions, wherein the recycle ratio in a reaction stage cannot be larger than the recycle ratio in a preceding reaction stage, and wherein the final reaction stage has no recycle stream.

2. The process of claim 1 wherein the at least a portion of a product effluent from the reaction stage preceding the final reaction stage is contacted with hydrogen to produce a product effluent/hydrogen mixture which is contacted with the final catalyst in step (e).

3. The process of claim 1, wherein one or more current reaction stages is present between the first reaction stage and the final reaction stage.

4. The process of claim 3, wherein step (d') comprises (i) providing a preceding product effluent, which is the product effluent from a preceding reaction stage, to the current reaction stage; (ii) contacting at least a portion of the preceding product effluent with hydrogen to produce a preceding product effluent/hydrogen mixture, wherein the hydrogen is dissolved in the preceding product effluent/hydrogen mixture; (iii) contacting the preceding product effluent/hydrogen mixture with a current catalyst to produce a current product effluent; and (iv) feeding the current product effluent to a subsequent reaction stage.

5. The process of claim 3, wherein step (d') comprises (i) providing a preceding product effluent, which is the product effluent from a preceding reaction stage, to the current reaction stage; (ii) contacting the preceding product effluent with a current recycle stream; (iii) contacting the preceding product effluent and the current recycle stream with a current catalyst to produce a current product effluent; (iv) recycling a portion of the current product effluent as the current recycle stream at a current recycle ratio of from about 0.1 to about 10; and (v) feeding the current product effluent to a subsequent reaction stage.

6. The process of claim 3, wherein step (d') comprises, for each current reaction stage, (i) providing a preceding product effluent, which is the product effluent from a preceding reaction stage, to the current reaction stage; (ii) contacting the preceding product effluent with hydrogen; (iii) contacting the preceding product effluent with a current recycle stream; (iv) contacting the preceding product effluent with a current catalyst to produce a current product effluent; (v) recycling a portion of the current product effluent as the current recycle stream; and (vi) feeding the current product effluent to a subsequent reaction stage, wherein the recycle ratio of current recycle stream to product effluent from the preceding reaction stage is from about 0.1 to about 10.

7. The process of claim 6 wherein each of the first and the current reaction stage contains one independent liquid recycle stream with a corresponding recycle ratio.

8. The process of claim 7 wherein the recycle ratio of a reaction stage is larger than the recycle ratio of a subsequent reaction stage.

9. The process of claim 1 having two reaction stages.

10. The process of claim 1, wherein each catalyst bed has a temperature from about 204° C. to about 450° C., a pressure from about 3.45 MPa (34.5 bar) to 17.3 MPa (173 bar), and a hydrocarbon feed rate to provide a liquid hourly space velocity (LHSV) of from about 0.1 to about 10 $hr^{-1}$.

11. The process of claim 1, wherein the diluent comprises the first recycle stream and an organic liquid selected from the group consisting of light hydrocarbons, light distillates, naphtha, diesel, propane, butane, pentane, hexane and combinations thereof.

12. The process of claim 1, wherein the diluent is the first recycle stream.

13. The process of claim 1, wherein each reaction stage contains at least one catalyst bed and fresh hydrogen is added at the inlet of each catalyst bed.

14. The process of claim 1, wherein at least one catalyst is a hydrotreating catalyst or a hydrocracking catalyst.

15. The process of claim 14, wherein one or more catalyst beds which contain a hydrotreating catalyst are followed by one or more catalyst beds which contain a hydrocracking catalyst.

16. The process of claim 14 wherein the hydrotreating catalyst comprises a metal and an oxide support wherein the metal is a non-precious metal.

17. The process of claim 14 wherein the hydrocracking catalyst comprises a metal and an oxide support wherein the metal is a non-precious metal.

18. The process of claim 1, wherein each catalyst comprises a metal which is a combination of metals selected from the group consisting of nickel-molybdenum (NiMo), cobalt-molybdenum (CoMo), nickel-tungsten (NiW) and cobalt-tungsten (CoW).

19. The process of claim 1, wherein there is no separation of ammonia, hydrogen sulfide and remaining hydrogen from the product effluent from a first catalyst bed or the product effluent from a preceding catalyst bed prior to feeding the product effluent to a subsequent catalyst bed.

20. The process of claim 1, wherein ammonia and hydrogen sulfide are removed from the product effluent from a first catalyst bed or the product effluent from a preceding catalyst bed prior to feeding the product effluent to a subsequent catalyst bed.

21. The process of claim 1, wherein the first recycle ratio is from about 0.1 to about 6.

* * * * *